US009873951B2

(12) United States Patent
Kaczur et al.

(10) Patent No.: US 9,873,951 B2
(45) Date of Patent: Jan. 23, 2018

(54) HIGH PRESSURE ELECTROCHEMICAL CELL AND PROCESS FOR THE ELECTROCHEMICAL REDUCTION OF CARBON DIOXIDE

(71) Applicant: Liquid Light, Inc., Monmouth Junction, NJ (US)

(72) Inventors: Jerry J. Kaczur, North Miami Beach, FL (US); Narayanappa Sivasankar, Plainsboro, NJ (US); Emily Barton Cole, Houston, TX (US)

(73) Assignee: Avantium Knowledge Centre B.V., Amsterdam (NL)

( * ) Notice: Subject to any disclaimer, the term of this patent is extended or adjusted under 35 U.S.C. 154(b) by 0 days.

(21) Appl. No.: 14/427,934

(22) PCT Filed: Sep. 16, 2013

(86) PCT No.: PCT/US2013/060004

§ 371 (c)(1),
(2) Date: Mar. 12, 2015

(87) PCT Pub. No.: WO2014/043651

PCT Pub. Date: Mar. 20, 2014

(65) Prior Publication Data

US 2015/0267309 A1 Sep. 24, 2015

Related U.S. Application Data

(63) Continuation of application No. 13/724,885, filed on Dec. 21, 2012, now Pat. No. 8,858,777, which is a
(Continued)

(51) Int. Cl.
*C25B 9/10* (2006.01)
*C25B 11/02* (2006.01)
(Continued)

(52) U.S. Cl.
CPC ..... *C25B 9/10* (2013.01); *C25B 1/00* (2013.01); *C25B 3/04* (2013.01); *C25B 9/00* (2013.01);
(Continued)

(58) Field of Classification Search
None
See application file for complete search history.

(56) References Cited

U.S. PATENT DOCUMENTS 1,280,622 A 10/1918 Andrews
1,962,140 A 6/1934 Dreyfus
(Continued)

FOREIGN PATENT DOCUMENTS

FR 853643 3/1940
GB 1285209 A 8/1972
(Continued)

OTHER PUBLICATIONS

Kohjiro Hara et al., High Efficiency Electrochemical Reduction of Carbon Dioxide under High Pressure on a Gas Diffusion Electrode Containing Pt Catalysts, J. Electrochem. Soc., vol. 142, No. 4, Apr. 1995, pp. L57-L59.
(Continued)

*Primary Examiner* — Harry D Wilkins, III
(74) *Attorney, Agent, or Firm* — Suiter Swantz PC LLO

(57) ABSTRACT

The present disclosure the present disclosure is directed to an electrochemical cell including an exterior pressure vessel, the exterior pressure vessel including a cylindrical body, a first end removably fastened to the cylindrical body to cover a first opening of the cylindrical body and a second end removably fastened to the cylindrical body to cover a second opening of the cylindrical body. The electrochemical cell may further include high surface area electrodes which may
(Continued)

be configured to operate at high pressures, such as in the range of 2 to 100 atmospheres or more.

9 Claims, 12 Drawing Sheets

Related U.S. Application Data continuation of application No. 13/724,988, filed on Dec. 21, 2012, now abandoned.

(60) Provisional application No. 61/701,282, filed on Sep. 14, 2012.

(51) Int. Cl.

| | |
|---|---|
| ***C25B 3/04*** | (2006.01) |
| ***C25B 15/08*** | (2006.01) |
| ***C25B 9/00*** | (2006.01) |
| ***C25B 1/00*** | (2006.01) |
| ***C25B 11/03*** | (2006.01) |

(52) U.S. Cl.
CPC ..... *C25B 11/02* (2013.01); *C25B 11/035* (2013.01); *C25B 15/08* (2013.01)

(56) References Cited

U.S. PATENT DOCUMENTS 2,060,880 A 11/1936 Lazier et al.
3,019,256 A 1/1962 Dunn
3,088,990 A 5/1963 Rightmire et al.
3,220,941 A 11/1965 Osborne et al.
3,236,879 A 2/1966 Chiusoli
3,293,292 A 12/1966 Olivier et al.
3,326,998 A 6/1967 Reusser et al.
3,341,615 A 9/1967 Wulf et al.
3,341,616 A 9/1967 Vives
3,344,046 A 9/1967 Neikam
3,347,758 A 10/1967 Koehl
3,352,935 A 11/1967 Mahan
3,361,653 A 1/1968 Miller
3,401,100 A 9/1968 Macklin
3,492,209 A 1/1970 Miller
3,531,386 A 9/1970 Heredy
3,560,354 A 2/1971 Young
3,607,962 A 9/1971 Krekeler et al.
3,636,159 A 1/1972 Solomon
3,720,591 A 3/1973 Skarlos
3,745,180 A 7/1973 Rennie
3,764,492 A 10/1973 Baizer et al.
3,779,875 A 12/1973 Michelet
3,824,163 A 7/1974 Maget
3,894,059 A 7/1975 Selvaratnam
3,959,094 A 5/1976 Steinberg
4,042,481 A * 8/1977 Kelly ..... C25B 9/06 204/270
4,072,583 A 2/1978 Hallcher et al.
4,087,470 A 5/1978 Suzuki
4,088,682 A 5/1978 Jordan
4,118,305 A 10/1978 Oloman et al.
4,147,599 A 4/1979 O'Leary et al.
4,162,948 A 7/1979 Yagii et al.
4,204,034 A 5/1980 Schaer
4,219,392 A 8/1980 Halmann
4,245,114 A 1/1981 Peltzman
4,253,921 A 3/1981 Baldwin et al.
4,256,550 A 3/1981 Niinobe et al.
4,267,070 A 5/1981 Nefedov et al.
4,299,981 A 11/1981 Leonard
4,334,967 A 6/1982 Tedoradze et al.
4,343,690 A 8/1982 De Nora
4,381,978 A 5/1983 Gratzel et al.
4,384,084 A 5/1983 Lohse et al.
4,421,613 A 12/1983 Goodridge et al.
4,436,793 A * 3/1984 Adlhart ..... H01M 8/065 429/421
4,450,055 A 5/1984 Stafford
4,476,003 A 10/1984 Frank et al.
4,510,214 A 4/1985 Crouse et al.
4,523,981 A 6/1985 Ang et al.
4,545,866 A 10/1985 De Nora et al.
4,545,886 A 10/1985 de Nora et al.
4,547,271 A 10/1985 Bharucha et al.
4,560,451 A 12/1985 Nielsen
4,563,254 A 1/1986 Morduchowitz et al.
4,589,963 A 5/1986 Cipriano et al.
4,595,465 A 6/1986 Ang et al.
4,608,132 A 8/1986 Sammells
4,608,133 A 8/1986 Morduchowitz et al.
4,619,374 A * 10/1986 Yavorsky ..... F17C 1/06 137/590
4,619,743 A 10/1986 Cook
4,661,422 A 4/1987 Marianowski et al.
4,673,473 A 6/1987 Ang et al.
4,702,973 A 10/1987 Marianowski
4,732,655 A 3/1988 Morduchowitz et al.
4,737,257 A 4/1988 Boulton
4,756,807 A 7/1988 Meyer et al.
4,790,914 A * 12/1988 Sorenson ..... C25B 1/46 204/237
4,810,596 A 3/1989 Ludwig
4,845,252 A 7/1989 Schmidt et al.
4,902,828 A 2/1990 Wickenhaeuser et al.
4,950,368 A 8/1990 Weinberg et al.
4,968,393 A 11/1990 Mazur et al.
5,074,974 A 12/1991 Toomey, Jr.
5,084,148 A 1/1992 Kazcur et al.
5,096,054 A 3/1992 Scherson
5,106,465 A 4/1992 Kaczur et al.
5,107,040 A 4/1992 Repman et al.
5,155,256 A 10/1992 Chapman
5,198,086 A 3/1993 Chlanda et al.
5,198,311 A 3/1993 Nakazawa et al.
5,246,551 A 9/1993 Pletcher et al.
5,290,404 A 3/1994 Toomey et al.
5,300,369 A 4/1994 Dietrich et al.
5,294,319 A 5/1994 Kaczur et al.
5,316,644 A 5/1994 Titterington et al.
5,412,150 A 5/1995 Wessel
5,443,804 A 8/1995 Parker et al.
5,455,372 A 10/1995 Hirai et al.
5,474,658 A 12/1995 Scharbert et al.
5,482,792 A 1/1996 Faita et al.
5,514,492 A 5/1996 Marincic et al.
5,536,856 A 7/1996 Harrison et al.
5,565,072 A 10/1996 Faita et al.
5,578,388 A 11/1996 Faita et al.
5,654,493 A 8/1997 Wessel
5,716,503 A 2/1998 Dean et al.
5,804,045 A 9/1998 Orillon et al.
5,916,514 A 6/1999 Eshraghi
5,928,808 A 7/1999 Eshraghi
5,961,813 A 10/1999 Gestermann et al.
5,989,300 A 11/1999 Eshraghi
6,001,500 A 12/1999 Bass et al.
6,024,935 A 2/2000 Mills et al.
6,103,413 A 8/2000 Hinton et al.
6,137,005 A 10/2000 Honevik
6,146,780 A 11/2000 Cisar et al.
6,171,551 B1 1/2001 Malchesky et al.
6,171,719 B1 1/2001 Roy et al.
6,251,256 B1 6/2001 Blay et al.
6,287,721 B1 9/2001 Xie et al.
6,312,655 B1 11/2001 Hesse et al.
6,348,613 B2 2/2002 Miyamoto et al.
6,365,032 B1 4/2002 Shiepe et al.
6,380,446 B1 4/2002 Drew et al.
6,465,699 B1 10/2002 Grosso
6,492,047 B1 12/2002 Peled et al.
6,527,921 B2 3/2003 Kirk et al.
6,576,362 B2 6/2003 Hanlon
6,666,961 B1 12/2003 Skoczylas et al.
6,706,436 B2 3/2004 Molter

(56) References Cited

U.S. PATENT DOCUMENTS 6,777,571 B2 8/2004 Chaturvedi et al.
6,852,441 B2 2/2005 Milgate, Jr. et al.
6,881,320 B1 4/2005 Krafton et al.
6,949,178 B2 9/2005 Tennakoon et al.
7,125,625 B2 10/2006 Cisar et al.
7,138,201 B2 11/2006 Inoue et al.
7,462,752 B2 12/2008 Fong et al.
7,611,618 B2 * 11/2009 Davidson ..... C25B 1/04 205/341
7,754,366 B2 7/2010 Nakanishi et al.
7,883,610 B2 2/2011 Monzyk et al.
8,227,127 B2 7/2012 Little et al.
8,277,631 B2 10/2012 Eastman et al.
8,313,634 B2 11/2012 Bocarsly et al.
8,388,818 B1 * 3/2013 Menezes ..... C25B 1/003 204/248
8,444,844 B1 5/2013 Teamey et al.
8,562,811 B2 10/2013 Sivasankar et al.
8,663,447 B2 3/2014 Bocarsly et al.
8,721,866 B2 5/2014 Sivasankar et al.
9,090,976 B2 7/2015 Bocarsly et al.
2001/0001798 A1 5/2001 Sharpless et al.
2001/0026884 A1 10/2001 Appleby et al.
2002/0013477 A1 1/2002 Kim et al.
2002/0022753 A1 2/2002 Drew et al.
2002/0122980 A1 9/2002 Fleischer et al.
2004/0006246 A1 1/2004 Sherman et al.
2004/0115489 A1 6/2004 Goel
2005/0139486 A1 6/2005 Carson et al.
2005/0245784 A1 11/2005 Carson et al.
2006/0102468 A1 5/2006 Monzyk et al.
2006/0269813 A1 11/2006 Seabaugh et al.
2007/0004023 A1 1/2007 Trachtenberg et al.
2007/0012577 A1 1/2007 Bulan et al.
2007/0151865 A1 * 7/2007 Shimko ..... C25B 1/10 205/628
2007/0224479 A1 9/2007 Tadokoro et al.
2008/0223727 A1 9/2008 Oloman et al.
2008/0245660 A1 10/2008 Little et al.
2008/0248350 A1 10/2008 Little et al.
2008/0283121 A1 * 11/2008 Guerra ..... B01J 21/063 136/259
2008/0283411 A1 11/2008 Eastman et al.
2008/0286643 A1 11/2008 Iwasaki
2008/0296146 A1 12/2008 Toulhoat et al.
2008/0314758 A1 12/2008 Grosso
2009/0000956 A1 1/2009 Weidner et al.
2009/0014336 A1 1/2009 Olah et al.
2009/0030240 A1 1/2009 Olah et al.
2009/0057161 A1 3/2009 Aulich et al.
2009/0062110 A1 3/2009 Koshino et al.
2009/0156867 A1 6/2009 Van Kruchten
2009/0159454 A1 6/2009 Machado et al.
2009/0308759 A1 12/2009 Waycuilis
2010/0051859 A1 3/2010 House et al.
2010/0061922 A1 3/2010 Rauser et al.
2010/0069600 A1 3/2010 Morelle et al.
2010/0086824 A1 * 4/2010 Homel ..... C25B 1/00 429/406
2010/0130768 A1 5/2010 Sato et al.
2010/0140103 A1 6/2010 Gilliam et al.
2010/0187123 A1 7/2010 Bocarsly et al.
2010/0187125 A1 7/2010 Sandoval et al.
2010/0191024 A1 7/2010 Uenveren et al.
2010/0196800 A1 8/2010 Markoski et al.
2010/0248042 A1 9/2010 Nakagawa et al.
2010/0270167 A1 10/2010 McFarland
2010/0276299 A1 * 11/2010 Kelly ..... C25B 1/12 205/628
2010/0282614 A1 11/2010 Detournay et al.
2010/0305629 A1 12/2010 Lund et al.
2010/0330435 A1 12/2010 Nemeth et al.
2011/0024288 A1 2/2011 Bhavaraju et al.
2011/0083968 A1 4/2011 Gillliam et al.
2011/0114501 A1 5/2011 Teamey et al.
2011/0114502 A1 5/2011 Cole et al.
2011/0114503 A1 5/2011 Sivasankar et al.
2011/0114504 A1 5/2011 Sivasankar et al.
2011/0143224 A1 6/2011 Rittmann et al.
2011/0143929 A1 6/2011 Sato et al.
2011/0177398 A1 7/2011 Affinito et al.
2011/0186441 A1 8/2011 LaFrancois et al.
2011/0217226 A1 9/2011 Mosa et al.
2011/0226632 A1 9/2011 Cole et al.
2011/0237830 A1 9/2011 Masel
2011/0303551 A1 12/2011 Gilliam et al.
2011/0318617 A1 12/2011 Kirchev et al.
2012/0004448 A1 1/2012 Bhattacharyya et al.
2012/0004449 A1 1/2012 Bhattacharyya
2012/0004454 A1 1/2012 Bhattacharyya et al.
2012/0018311 A1 1/2012 Yotsuhashi et al.
2012/0043301 A1 2/2012 Arvin et al.
2012/0132537 A1 5/2012 Sivasankar et al.
2012/0132538 A1 5/2012 Cole et al.
2012/0199493 A1 8/2012 Krafft et al.
2012/0215034 A1 8/2012 McFarland
2012/0228147 A1 9/2012 Sivasankar et al.
2012/0277465 A1 11/2012 Cole et al.
2012/0292196 A1 11/2012 Albrecht et al.
2012/0295172 A1 11/2012 Peled et al.
2012/0298522 A1 11/2012 Shipchandler et al.
2012/0329657 A1 12/2012 Eastman et al.
2013/0062216 A1 3/2013 Yotsuhashi et al.
2013/0098772 A1 4/2013 Bocarsly et al.
2013/0105304 A1 5/2013 Kaczur et al.
2013/0105330 A1 5/2013 Teamey et al.
2013/0118907 A1 5/2013 Deguchi et al.
2013/0118909 A1 5/2013 Kaczur et al.
2013/0118911 A1 5/2013 Sivasankar et al.
2013/0134048 A1 5/2013 Teamey et al.
2013/0134049 A1 5/2013 Teamey et al.
2013/0137898 A1 5/2013 Teamey et al.
2013/0140187 A1 6/2013 Teamey et al.
2013/0180863 A1 7/2013 Kaczur et al.
2013/0180865 A1 7/2013 Cole et al.
2013/0186771 A1 7/2013 Zhai et al.
2013/0199937 A1 8/2013 Cole et al.
2014/0202877 A1 * 7/2014 Greenbaum ..... C25B 11/02 205/630
2015/0197864 A1 * 7/2015 Greenbaum ..... C25B 1/10 204/266

FOREIGN PATENT DOCUMENTS

JP 64-015388 1/1989
WO 1991/001947 A1 2/1991
WO WO 9724320 A1 7/1997
WO WO 2007041872 A1 4/2007
WO 2007/091616 A1 8/2007
WO 2011116236 A2 9/2011
WO WO 2012046362 A1 4/2012

OTHER PUBLICATIONS

Fred Mitlitsky et al., Applications and Development of High Pressure PEM Systems, Portable Fuel Cells Conference, Lucerne, Switzerland, Jun. 21-24, 1999, 18 pages.
Muthanna H. Al-Dahhan et al., High-Pressure Trickle-Bed Reactors: A Review, Ind. Eng. Chem. Res., Apr. 4, 1997, vol. 36, pp. 3292-3314.
Mark Matzopoulos, Advanced modelling accelerates fuel cell development, Fuel Cell Focus, Fuel Cell Design/Modelling, Sep. 2007, pp. 44-47.
M.V. Ciocco et al., Water-Gas Shift Membrane Reactor Studies, International Technical Conference, 28th, Coal Utilization & Fuel Systems, Clearwater, FL, 2003, 12 pages.

* cited by examiner

Orientation of Anodes and Cathodes
Top View

Anode Structure
with
Membrane or
Separator

HIGH PRESSURE ELECTROCHEMICAL CELL AND PROCESS FOR THE ELECTROCHEMICAL REDUCTION OF CARBON DIOXIDE

CROSS REFERENCE TO RELATED APPLICATIONS

The present application claims the benefit under 35 U.S.C. §119(e) of U.S. Provisional Application Ser. No. 61/701,282 filed Sep. 14, 2012. The present application further claims the benefit of U.S. patent application Ser. No. 13/724,885 filed Dec. 21, 2012 and U.S. patent application Ser. No. 13/724,988 filed Dec. 21, 2012. The U.S. Provisional Application Ser. No. 61/701,282, U.S. patent application Ser. No. 13/724,885 filed Dec. 21, 2012 and U.S. patent application Ser. No. 13/724,988 filed Dec. 21, 2012 are incorporated by reference in their entirety.

TECHNICAL FIELD

The present application generally relates to electrochemical cells and more particularly to high pressure electrochemical cells which may be configured to obtain high Faradaic conversion yields of carbon dioxide to various single and multi-carbon products at high current densities.

BACKGROUND

The combustion of fossil fuels in activities such as the electricity generation, transportation, and manufacturing produces billions of tons of carbon dioxide annually. Research since the 1970s indicates increasing concentrations of carbon dioxide in the atmosphere may be responsible for altering the Earth's climate, changing the pH of the ocean, and other potentially damaging effects. Countries around the world, including the United States, are seeking ways to mitigate emissions of carbon dioxide.

One method of mitigating carbon dioxide emissions is to convert carbon dioxide into economically valuable materials such as fuels and industrial chemicals. If the carbon dioxide is converted using energy from renewable sources, it will be possible to both mitigate carbon dioxide emissions and to convert renewable energy into a chemical form that can be stored for later use. Electrochemical and photochemical pathways are likely mechanisms for carbon dioxide conversion.

Previous work in this field has many limitations, including the stability of systems used in the process, the efficiency of systems, the selectivity of the system or process for a desired chemical, the cost of materials used in systems/processes, the ability to effectively control the process, and the rate at which carbon dioxide is converted.

SUMMARY OF THE PREFERRED EMBODIMENTS

Accordingly, the present disclosure is directed to an electrochemical cell including an exterior pressure vessel, the exterior pressure vessel including a cylindrical body, a first end removably fastened to the cylindrical body to cover a first opening of the cylindrical body and a second end removably fastened to the cylindrical body to cover a second opening of the cylindrical body. The electrochemical cell may further include high surface area electrodes which may be configured to operate at high pressures, such as in the range of 2 to 100 atmospheres or more.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

The present disclosure is directed to an electrochemical cell which includes ion exchange membranes and high surface area electrodes which may be configured to operate at high pressures, such as in the range of 2 to 100 atmospheres or more. The high surface area electrodes may include catalyst coatings and substrate compositions configured for the reduction of carbon dioxide and operation at high pressure in order to achieve high Faradaic conversion of carbon dioxide to selected target single carbon, $C_1$, and multi-carbon, $C_{2+}$, chemical products at high operating current densities.

In order to make the electrochemical process commercially viable using a suitable catalyst, the electrochemical process preferably has a high Faradaic conversion efficiency for the selected product, and should operate at a sufficiently high current density, in a range of 0.2 to 20 $kA/m^2$ and higher. In order to achieve these objectives, one method is to employ high surface area cathode materials made with the selective catalyst material, which may be in the form of a solid material, or as a coating composition on a high surface area substrate. The catalyst material may be stable in the process, having a long operating life, and resistant to poisoning or deactivating in the process.

In addition to the use of high surface area electrodes, the use of high pressure in the electrochemical reduction reaction may increase the Faradaic current efficiency and operating current density of the electrochemical cell. The use of high pressure may increase solubility of the reactant, such as carbon dioxide, by a magnitude of 10 times or more as pressure is increased up to the supercritical point of carbon dioxide, which is another operational operating point.

The electrochemical cell of the present disclosure may allow maintenance on a single unit without the need to shut down an entire stack of electrochemical cells. The volume of the cathode structure may be varied in the present design, thus incorporating more surface area to reduce the electrode potential at the cathode surfaces for the optimum carbon dioxide electrode reduction reaction. Additionally, the electrochemical cell may be easily assembled and disassembled and may employ high surface area cathode structures which may be replaced or rejuvenated in situ.

Figure 1A:
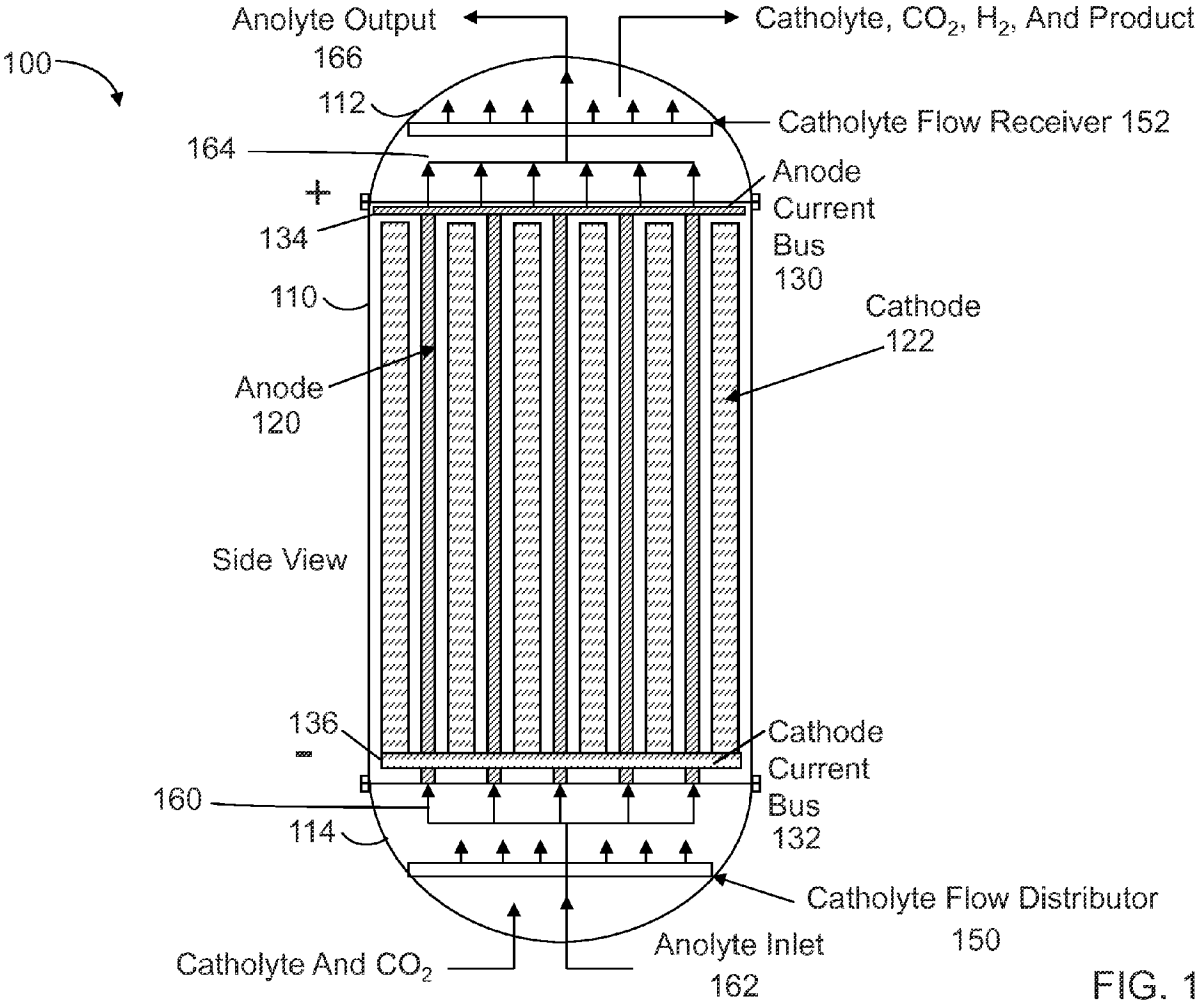
FIG. 1A depicts a side cut-away view of an electrochemical cell in accordance with an embodiment of the present disclosure.
Figure 1B:
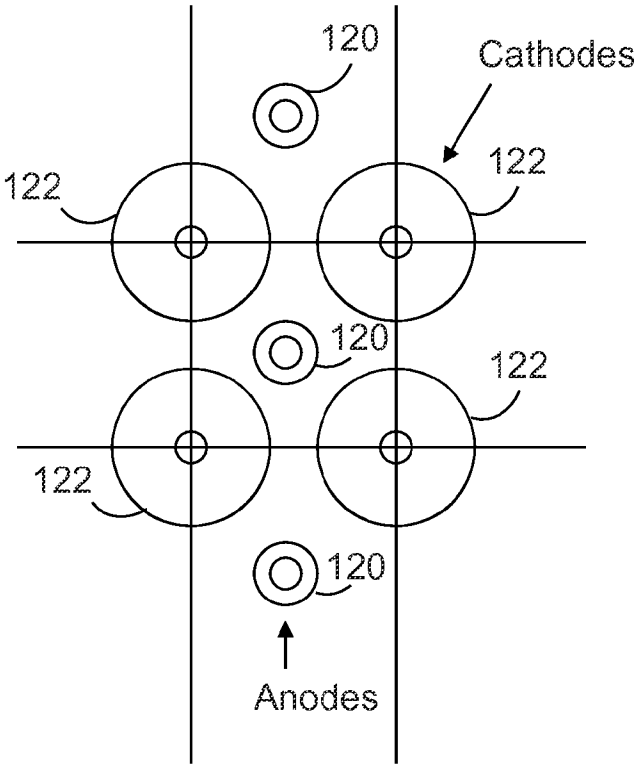
FIG. 1B depicts a top cut-away view of an electrochemical cell in accordance with an alternative embodiment of the present disclosure.

Referring to FIGS. 1A and 1B, multiple views of an electrochemical cell 100 in accordance with an embodiment of the present disclosure are shown. Electrochemical cell 100 may include a shell and tube configuration. An exterior pressure vessel of the electrochemical cell 100 may include a cylindrical body 110 with cylindrical dome ends 112, 114. In an alternative embodiment, flat ends may be employed but may reduce the pressure capability of the electrochemical cell 100. Advantageously, the cylindrical dome ends 112, 114 may be connected to the cylindrical body using a plurality of fasteners, such as nuts and bolts. This may allow efficient installation and removal of the dome ends 112, 114 which may allow access to the interior of the electrochemical cell 100. Access to the interior of the electrochemical cell 100 may facilitate installation, maintenance and removal of the anodes 120 and cathodes 122, for example. Upon removal of dome end 112 for example, anode current bus 130 may be removed and anodes 120 and cathodes 122 may be replaced or recoated.

Electrochemical cell 100 may include spatially arranged anodes 120 and cathodes 122 disposed in the interior of the pressure vessel (as depicted in FIG. 1B). In one embodiment, it is contemplated that anodes 120 and cathodes 122 may be formed as tubes wherein each anode tube may be surrounded by at least four cathode tubes. In alternative embodiments, various arrangements and numbers of anodes 120 and cathodes 122 may be employed to provide improved Faradaic yields for the electrochemical cell 100.

Anodes 120 may be connected to anode current bus 130. Anode current bus 130 may be located in the interior of the pressure vessel and may be connected to a positive terminal 134. Anode current bus 130 may be mounted within the interior of the cylindrical body 110 and may be located in proximity of the first opening of cylindrical body 110 covered by cylindrical dome end 112. Cathodes 122 may be connected to a cathode current bus 132, the cathode current bus 132 may be connected to the negative terminal 136. Cathode current bus 132 may be mounted within the interior of the cylindrical body 110 and may be located in proximity to the second opening of the cylindrical body 110 covered by cylindrical dome end 114. It is contemplated that a power supply (not shown) may be connected to the positive terminal 134 and negative terminal 136. It is contemplated that a variety of mechanisms which may be connected in a variety of ways to the terminals 134, 136 to supply power to the electrochemical cell 100 and control operation of the cell 100.

Electrochemical cell 100 may include a catholyte inlet and a catholyte flow distributor 150 which distributes catholyte within the electrochemical cell 100. A catholyte flow receiver 152 may collect the catholyte and the products which may be supplied to an outlet. The outlet may include catholyte, carbon dioxide, hydrogen and carbon dioxide reduction products. Catholyte flow distributor 150 and catholyte flow receiver 152 may be constructed of perforated metal or may be made of porous sintered metal to provide an efficient distribution of the solution flow into and out of the pressure vessel of the electrochemical cell 100. A catholyte aqueous solution, containing for example, potassium bicarbonate, with dissolved or sparged $CO_2$ liquid or gas, is pumped under pressure into the vessel through the catholyte inlet and then exits under pressure control, such as by a pressure controller (not shown), from the vessel via the catholyte outlet with the carbon dioxide reaction products.

Figure 3:
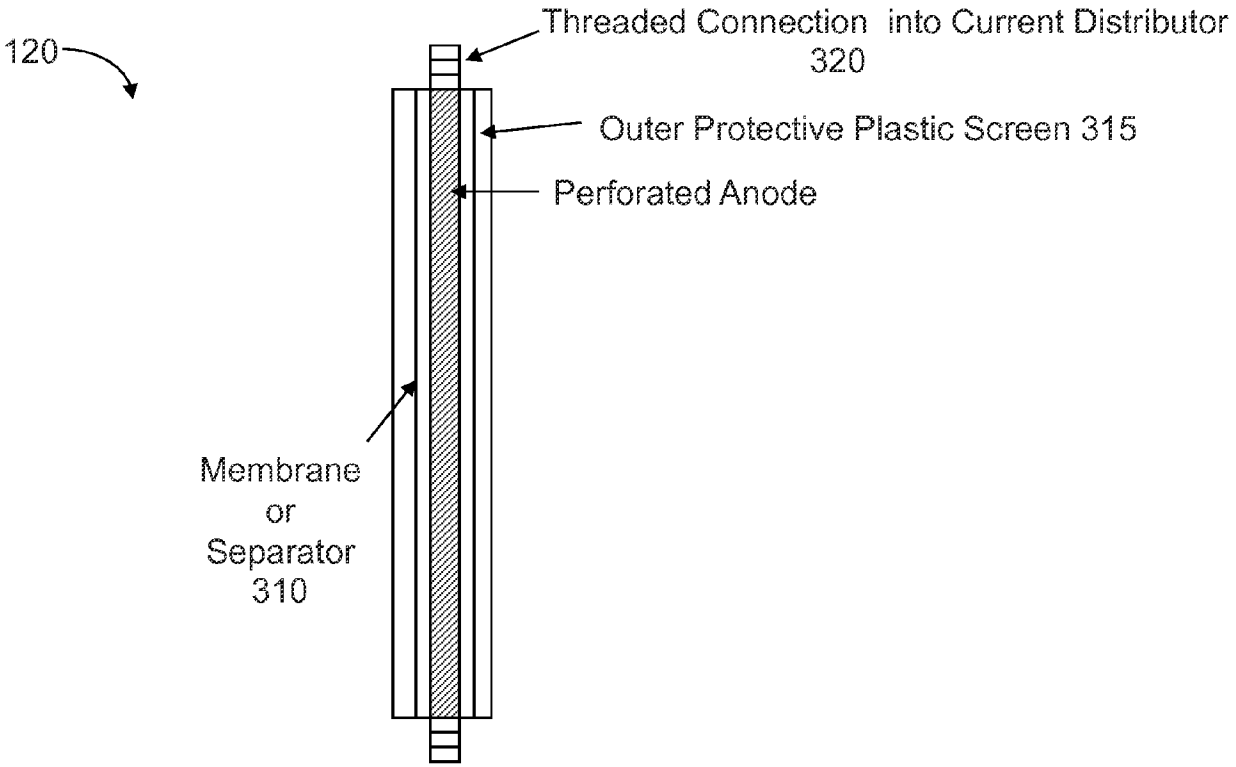
FIG. 3 depicts an exploded view of an anode in accordance with an embodiment of the present disclosure.

Electrochemical cell 100 may include an anolyte flow distributor 160 which receives anolyte from anolyte inlet 162. Anolyte flow distributor 160 may supply anolyte directly to a tube portion of each anode 120. An anolyte flow receiver 164 may receive the anolyte from anodes 120 and may be output via an anolyte outlet 166. An anolyte, such as dilute sulfuric acid, may be pumped through an anode flow distributor 160, such as a manifold distributor, and comes out through an anolyte flow receiver 164, such as anolyte flow manifold, under pressure control to match the feed pressure on the catholyte side. The pressures of the anolyte and catholyte sections may be equalized, otherwise high differential pressures may rupture the membrane or separator employed in the anode structure (as shown in FIG. 3). This may be done by use of one or more pressure controllers, such as various mechanical hydraulic mechanisms, in addition to electronic pressure controllers. These various pressure controllers may be used, both passive and active, to provide an equal or slight pressure differential between the anolyte section (the tube of the anode) and the catholyte section (the volume occupied by the cathode structures and catholyte within the electrochemical cell 100.

Figure 2:
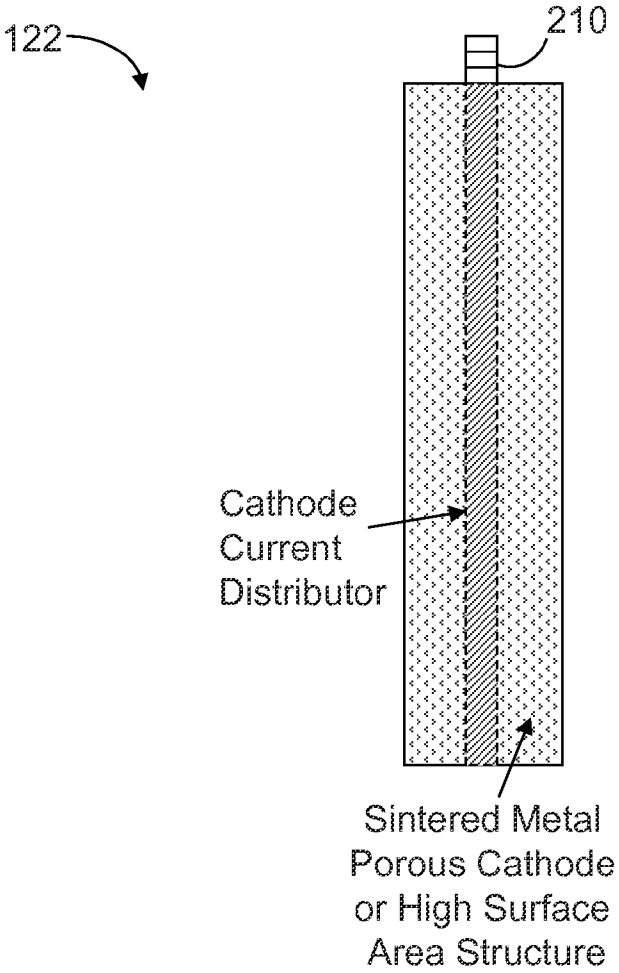
FIG. 2 depicts an exploded view of a cathode in accordance with an embodiment of the present disclosure.

Referring to FIG. 2, cathode 122 may be a sintered metal structure with a catalyst on the surfaces and may have a terminal end screw connection 210 which connects to a negative cathode current bus 132, which may be formed as a plate. It is contemplated that cathode 122 may be formed as a tube and may be a length that is approximately the length of the cylindrical body 110 of pressure vessel of electrochemical cell 110. In an alternative embodiment, the cathode 122 may be a metal cathode rod that is bonded or sintered to a high surface area cathode material containing a catalyst promoting the desired carbon dioxide reduction reaction on its surfaces. In another embodiment, cathode 122 may be a cylindrical tubular object with a central cathode tube, the central cathode tube including a current distributor and packed with a compressed high surface area material with catalyst surrounding it and including an external protective plastic screen.

Referring to FIG. 3, an anode 120 may include a current distributor in a form of an expanded or perforated metal central tubular form made from a conductive substrate. The conductive substrate may be a metal, such as titanium, having an anode catalyst on the anode surfaces. Outside the anode surface may be a woven or open area plastic screen or layers of a thin expanded metal titanium screen with catalyst coating. Outside the screen, a cylindrical cation exchange membrane or separator 310 is mounted and sealed on the outside ends onto the anode, and a plastic or perforated screen 315 may be placed outside the membrane or separator 310 to provide impact or mechanical damage protection for the anode assembly (the anode and the membrane). The anode assembly may include a threaded connection device 320 to allow coupling with the anode current bus 130. It is contemplated that anode 120 may be formed as a tube and may be a length that is approximately the length of the cylindrical body 110 of pressure vessel of electrochemical cell 110.

Figure 4A:
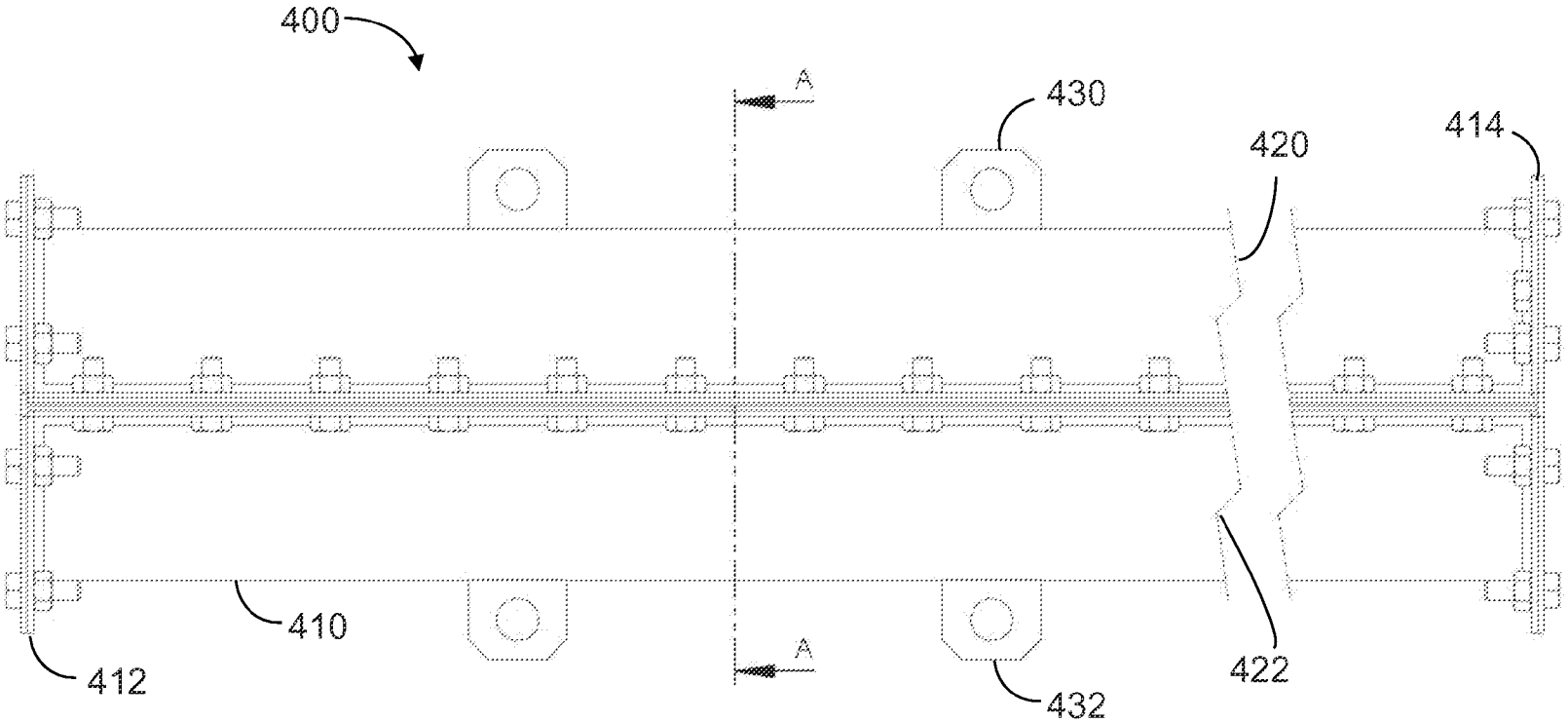
FIG. 4A depicts a side view of an electrochemical cell in accordance with an alternative embodiment of the present disclosure.
Figure 4B:
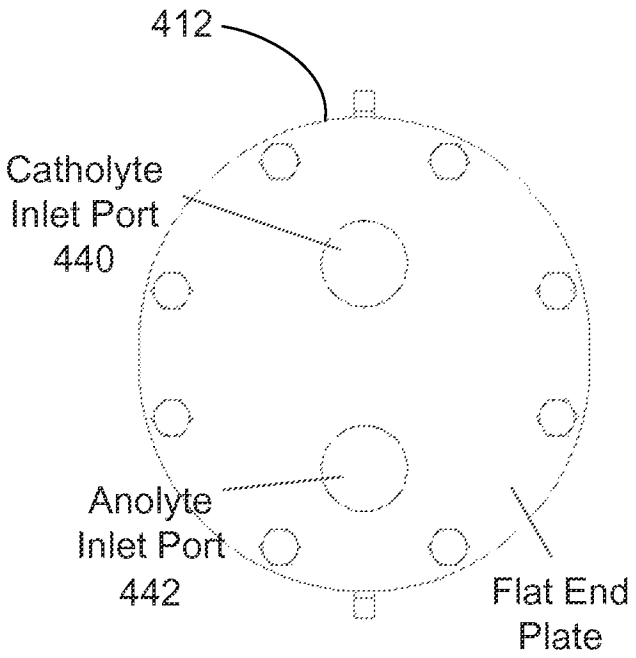
FIG. 4B depicts a top view of an electrochemical cell in accordance with an alternative embodiment of the present disclosure.
Figure 4C:
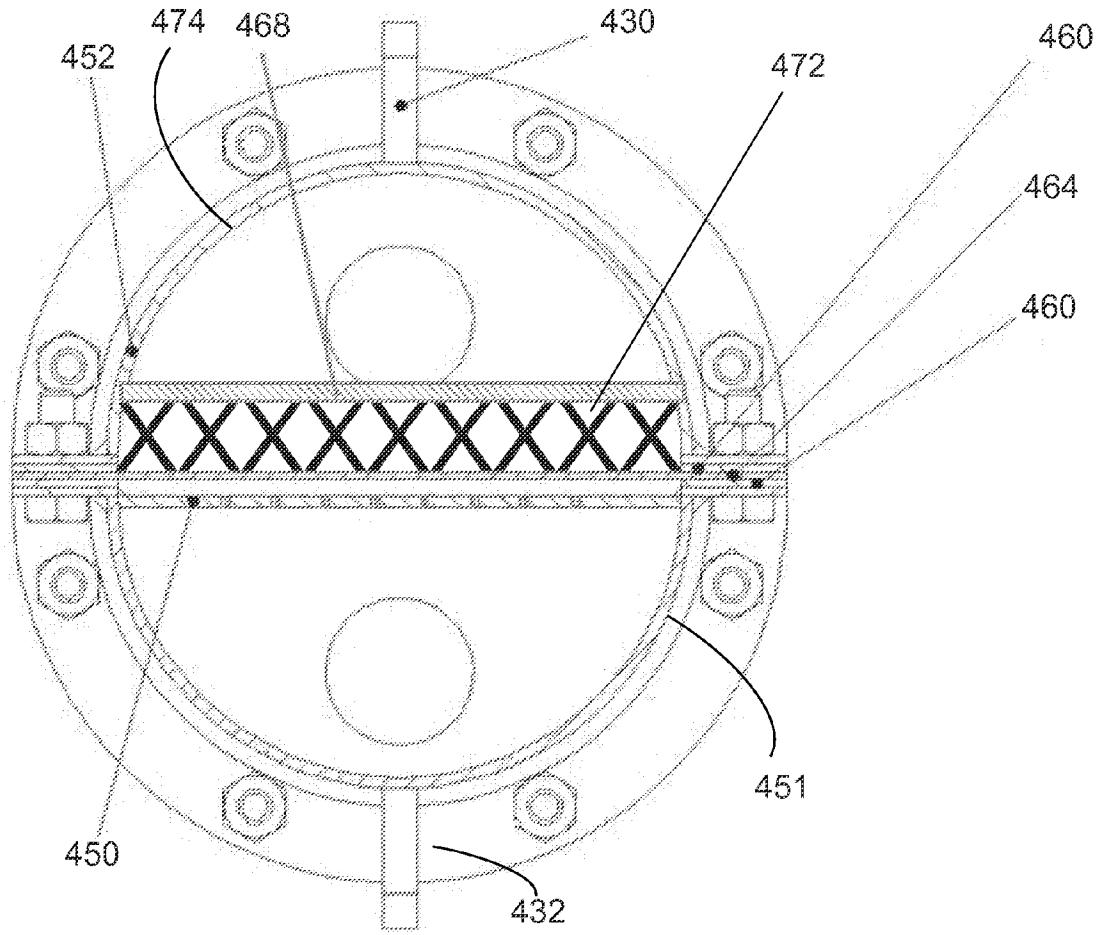
FIG. 4C depicts a top cut-away view of an electrochemical cell in accordance with an alternative embodiment of the present disclosure.

Referring to FIG. 4A-4C, an electrochemical cell 400 in accordance with an alternative embodiment of the present disclosure is shown. Electrochemical cell 400 may include an exterior pressure vessel. The exterior pressure vessel may include a cylindrical body 410 with cylindrical ends 412, 414. In an alternative embodiment, cylindrical ends 412, 414 may be cylindrical domed ends to increase the pressure capability of the electrochemical cell 400. Advantageously, the cylindrical ends 412, 414 may be connected to the cylindrical body 410 using a plurality of fasteners, such as nuts and bolts. This may allow efficient installation and removal of the cylindrical ends 412, 414. This may allow access to the interior of the electrochemical cell 400 which may allow installation, maintenance and removal of components of the electrochemical cell 400. It is further contemplated that the cylindrical body 410 may be formed with two semi-circular sections 420, 422 which may be connected together with fasteners, such as nuts and bolts. This is advantageous as it may allow easier installation and maintenance of the anode and cathode portions of the electrochemical cell 400. Electrochemical cell 400 may include electrical contacts, such as a negative terminal 430 and positive terminal 432 may allow coupling to the cathode and anode sections respectively.

Referring to FIG. 4B, an example of a cylindrical end 412, 414 is shown. Cylindrical end 412, 414 may include an anolyte port 440 and a catholyte port 442. It is contemplated that cylindrical end 412 may be an inlet end including an anolyte inlet port and a catholyte inlet port. Additionally, cylindrical end 414 may be an outlet end including an anolyte outlet port and a catholyte outlet port.

Referring to FIG. 4C, a cut-away top side view of the electrochemical cell 400 is shown. Electrochemical cell 400 may include an anode 450. Anode 450 may include a flat portion, such as a screen 455, which may include a current distributor. Anode 450 may also include a semi-circular portion, referred as the anode shell 451 connected to the screen 455. In one embodiment, anode shell 451 may be welded to the screen 455. Electrochemical cell 400 may include a cathode 452. Cathode 452 may include a flat portion which may include a current distributor 468. Flat portion of cathode may include a high surface area cathode material 472. Cathode 452 may also include a semi-circular portion connected to the flat portion and may be referred as a cathode shell 474. High surface area cathode material 472 may be electrically connected to cathode current distributor 468 and to cathode shell 474. The anode shell 451 may be connected to the positive terminal 432 and the cathode shell 474 may be connected to the negative terminal 430. It is contemplated that a power supply (not shown) may be connected to the negative terminal 430 and positive terminal 432. It is contemplated that a variety of mechanisms which may be connected in a variety of ways to the terminals 430, 432 to supply power to the electrochemical cell 400 and control operation of the cell 400.

The anode 450 may be associated with a half the cylinder (section 422) and the cathode 472 may be associated with half the cylinder (section 420) in one embodiment. Sections 420, 422 may be connected together via fasteners, such as by bolts, and may be sealed using a gasket material and insulator 460 may electrically isolate the bolts from the anode shell 451 and cathode shell 474. In such a fashion, it is contemplated that electrochemical cell 400 may include an electrochemical cell exterior anode and cathode surfaces which are accessible to the negative and positive connections to a DC power supply.

The cathode shell 474 may include a liner of the metallic catalyst, whether it is a metal, metal alloy, or metal with an electrocatalyst coating, and the space between a membrane 464 and cathode current distributor 468 may be filled with various materials, such as a high surface cathode material in the form of felts, fiber and fiber wools, felts, bead forms as metals, metallic materials used in packed tower packings, and so on. The electrical connections may be placed on an exterior of the cathode 452, such as electrical lug or post 430, using a copper bus, bar, plate, or cable as needed. Cathode 452 may include a cathode current distributor 468 and a high surface area cathode coating 472 as depicted in an exploded view in FIG. 5B.

Figure 5A:
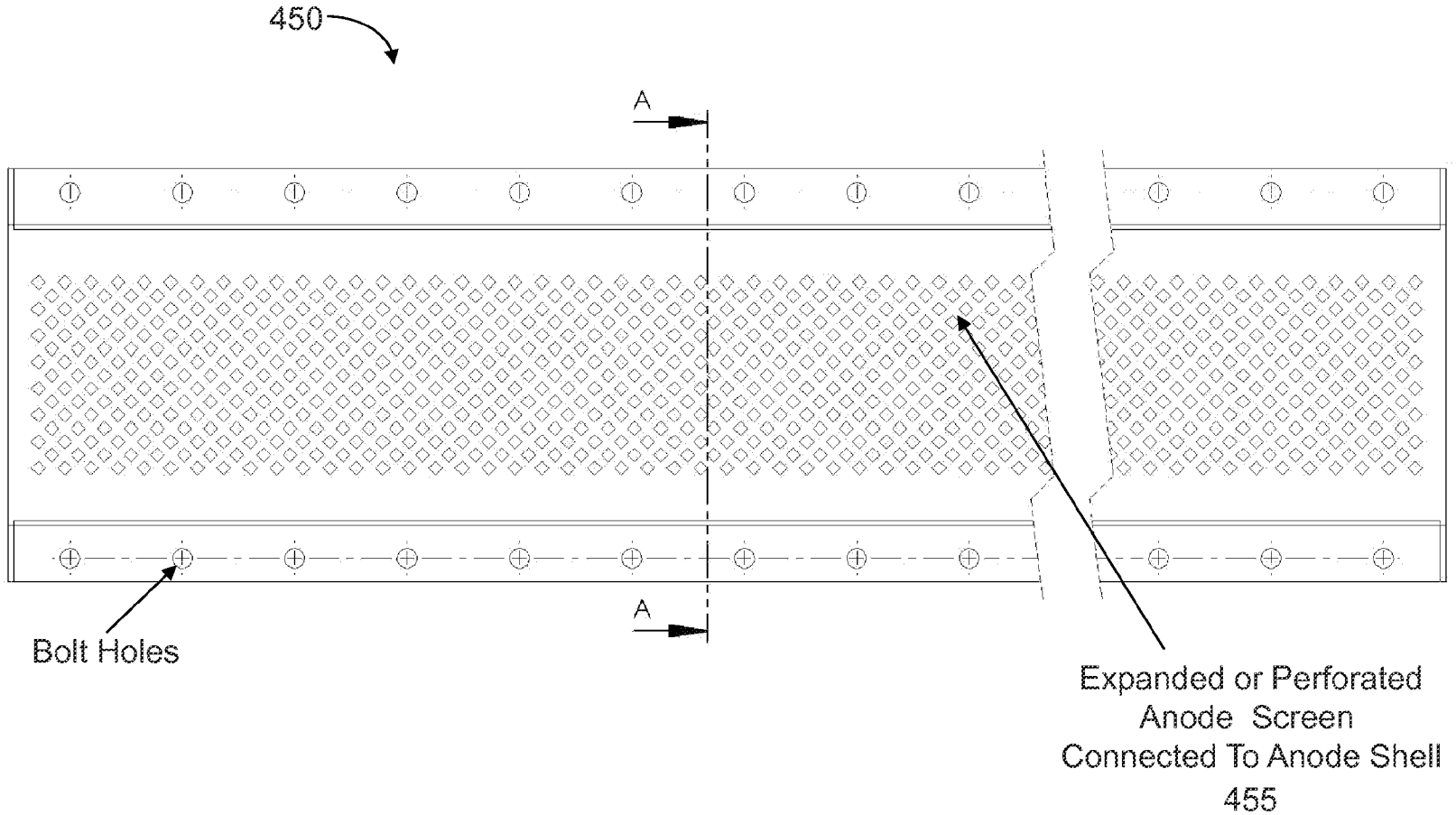
FIG. 5A depicts an exploded view of an anode of the electrochemical cell of FIGS. 4A-4C in accordance with an embodiment of the present disclosure.
Figure 5B:
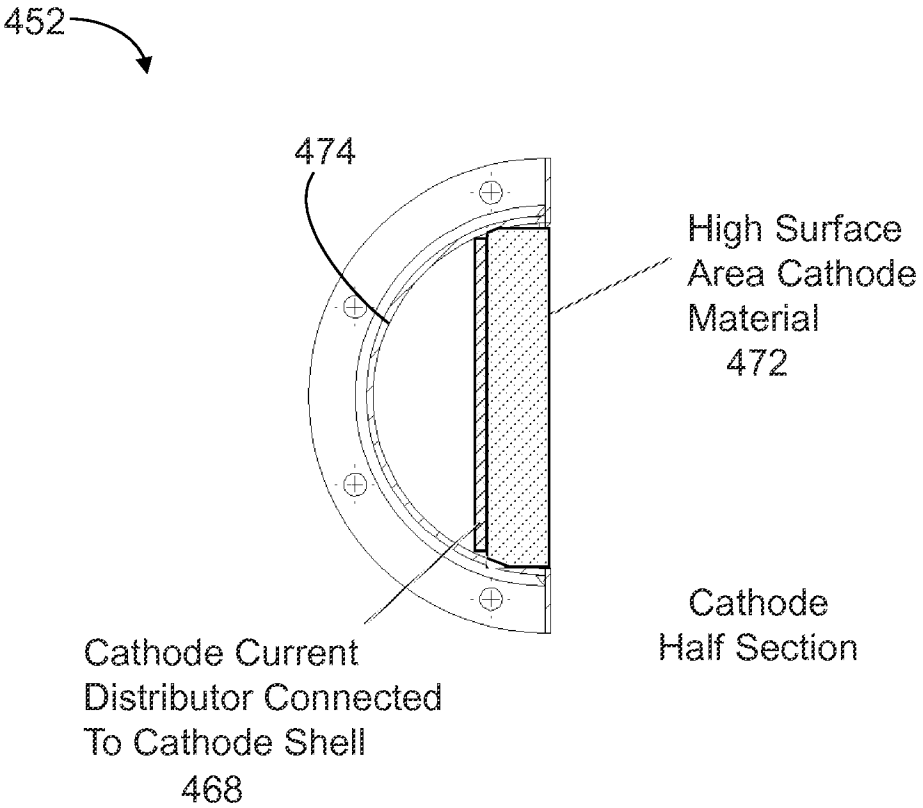
FIG. 5B depicts an exploded view of a cathode of the electrochemical cell of FIGS. 4A-4C in accordance with an embodiment of the present disclosure.
Figure 5C:
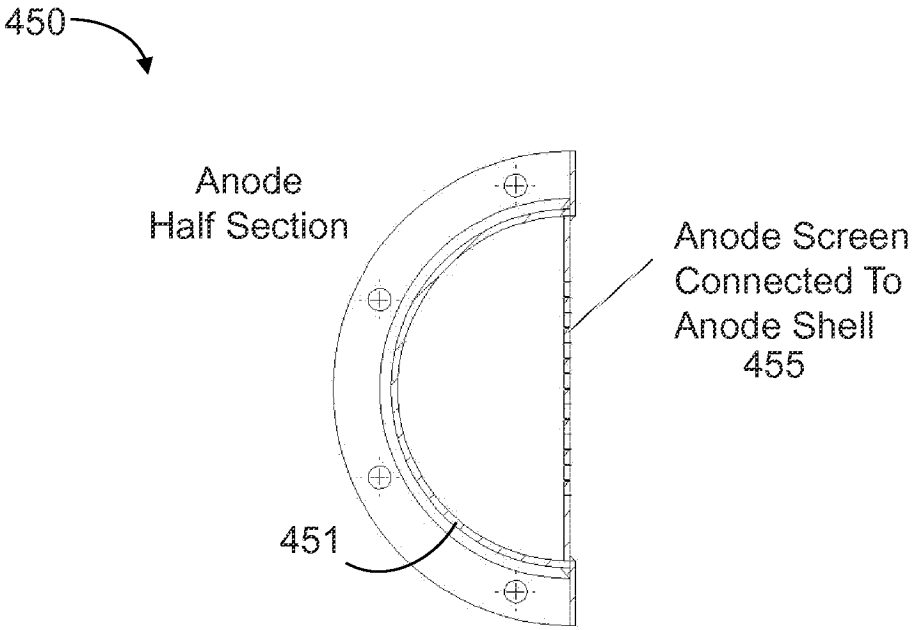
FIG. 5C is a top side view of an anode of the electrochemical cell of FIG. 5A in accordance with an embodiment of the present disclosure.

Referring to FIGS. 5A and 5C, anode 450 may be constructed of titanium, having an expanded or perforated titanium anode structure with an appropriate anode catalyst coating for the selected anolyte. Anode 450 may employ a plastic screen or a thin, folded titanium expanded screen 455 with the same anode catalyst coating placed between the anode 450 and the membrane 464. Anode screen 455 may be perforated, and may be an expanded metal type, and the perforations may extend to the edge of the anode. In one embodiment, anode screen 455 is connected to anode shell 451 to allow electrical conductivity, such as a welded connection.

The membrane 464 may be positioned, with gaskets between the anode 450 and cathode 452. In one embodiment, membrane 464 may be a reinforced type membrane, such as DuPont trade name Nafion 324 and the like. Membrane 464 may run a length of the cylindrical body between the anode 450 and cathode 452.

Electrochemical cell 400 may include ends 412, 414 which may be flat or may be domed to be able to handle higher pressures. The ends 412, 414 may include ports 440, 442 which may be threaded, which may accept a threaded piping or welded flanged connection to flow the anolyte and catholyte streams into and through the corresponding anolyte and catholyte compartments as well as out on the other end. The flow rate of the electrolytes may depend on the design and operating current density of the electrochemical cell 400.

A catholyte aqueous solution, containing for example, potassium bicarbonate, with $CO_2$ liquid or gas, may be pumped under pressure into the catholyte compartment, and exits under pressure control from the electrochemical cell 400 with the carbon dioxide reaction products.

On the anode side, an anolyte such as dilute sulfuric acid, is similarly pumped through the anode compartment, exiting out through the anolyte outlet under pressure control with gaseous anode reaction product, such as oxygen.

The inlet anolyte and catholyte sections of the electrochemical cell 400 may have flow distributors, such as perforated plate or porous sintered material to evenly distribute the flow into the compartments. The pressures of the anolyte and catholyte sections may be equalized via one or more pressure controllers. Pressure controllers may include active and passive devices and may include mechanical hydraulic mechanisms and electronic pressure controllers. These various pressure controllers may be used to provide an equal or slight pressure differential between the anolyte section and the catholyte section within the electrochemical cell 400.

It is contemplated the electrochemical cells of the present disclosure may further include a flooded trickle bed reactor using a high surface area cathode material in the form of fibers, felt, beads, and the like. In the design, the same type of anodes as in FIGS. 1A-1B may be employed. The cathode may fill the void volume not occupied by the anodes. In such a design, an electrochemical cell may include hollow tubes where cooling water may be used to cool the trickle bed reactor internals if the current density is high and the electrolyte needs to be cooled and operated in a specific temperature range.

The high pressure electrochemical design of FIGS. 1A-1B and FIGS. 4A-4C may also be used in different operation modes. The catholyte solution may be a non-aqueous solution, such as propylene carbonate, or any suitable aprotic solvent or ionic liquid and a cathode structure such as stainless steel (304L or 316L) or nickel where a $C_{2+}$ product such as oxalate may be produced from the electrochemical reduction of carbon dioxide. The solution may use a dissolved salt such as sodium bromide or tetrabutylammonium bromide as electrolyte salts.

Figure 6:
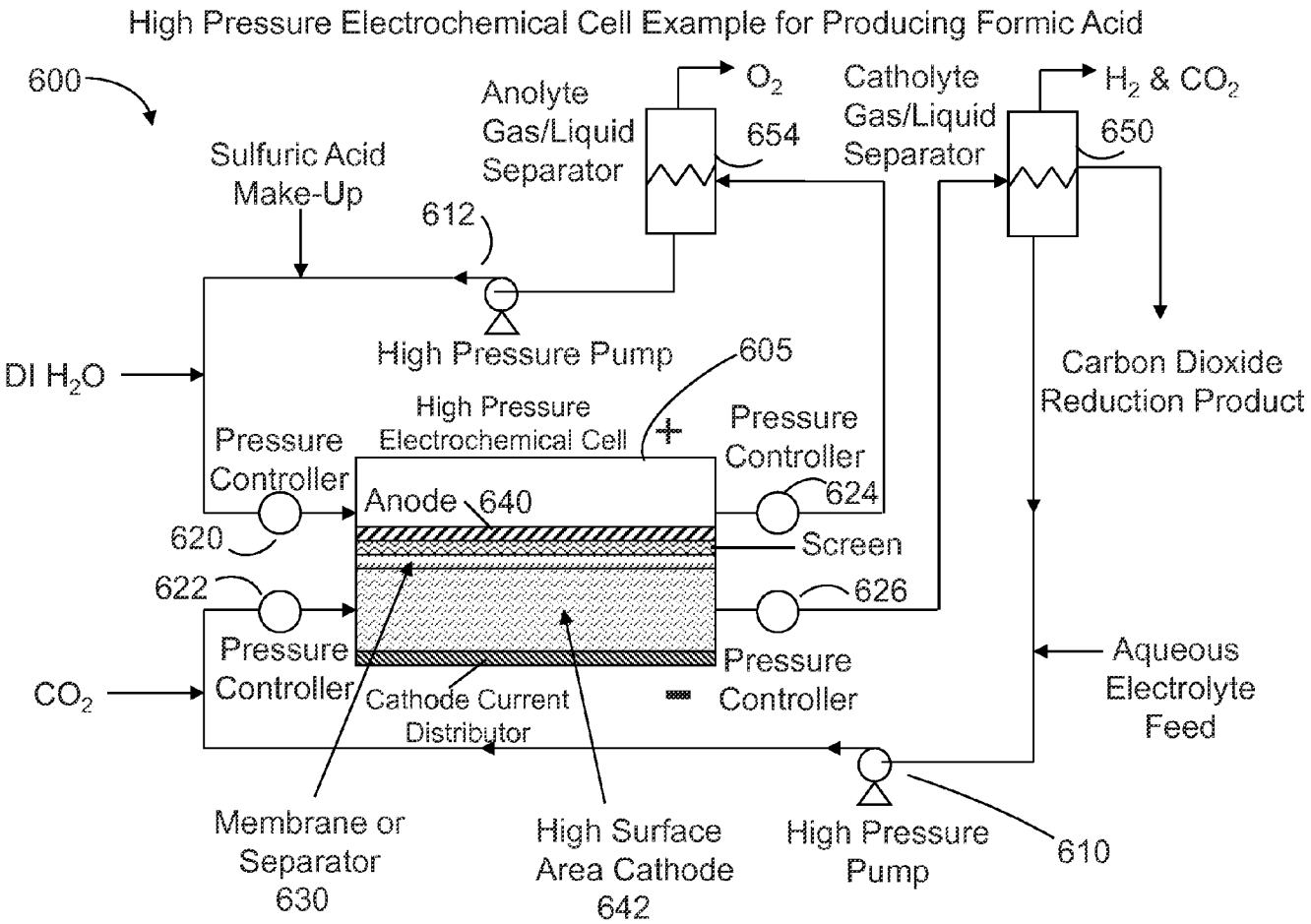
FIG. 6 depicts a system for producing formic acid employing a high pressure electrochemical cell in accordance with an embodiment of the present disclosure.

Referring to FIG. 6, a system 600 for obtaining high Faradaic conversion yields of carbon dioxide to various single and multi-carbon products employing a high pressure electrochemical cell 605 in accordance with an embodiment of the present disclosure is shown. A dilute sulfuric acid may be utilized as the anolyte and an aqueous solution, such as potassium carbonate, may be utilized as the catholyte. High pressure pumps 610, 612, may pressurize the feed solutions to the anolyte and catholyte and pressure controllers 620, 622, 624, 626 control the inlet and outlet pressures. A membrane 630, such as a DuPont Nafion 324 membrane, may be used to separate the anode 640 and cathode 642 compartments.

Carbon dioxide may be fed as a gas into the pressurized catholyte stream. The reduction products of carbon dioxide from the cathode reaction are sent to a catholyte gas/liquid separator 650, and the gas and liquid are separated and then overflow liquid product with the reduction product is then sent to a separation system (not shown) where it is separated from the liquid catholyte stream as a carbon dioxide reduction product.

The anolyte exit stream may be sent into an anolyte gas/liquid separator 654 where oxygen is formed as a byproduct in this example, and separated from the anolyte.

The cathode 642 employed is a high surface area cathode configured to allow operation of the electrochemical cell 605 at a high current density. Anode 640 may be connected to an anode current distributor (not shown) which may be connected to a positive terminal. Anode 640 may include a folded anode screen with an anode catalyst coating. It is contemplated that electrochemical cell 605 may be operable as cell 100 of FIG. 1A-1B or cell 400 of FIG. 4A-4C.

Figure 7:
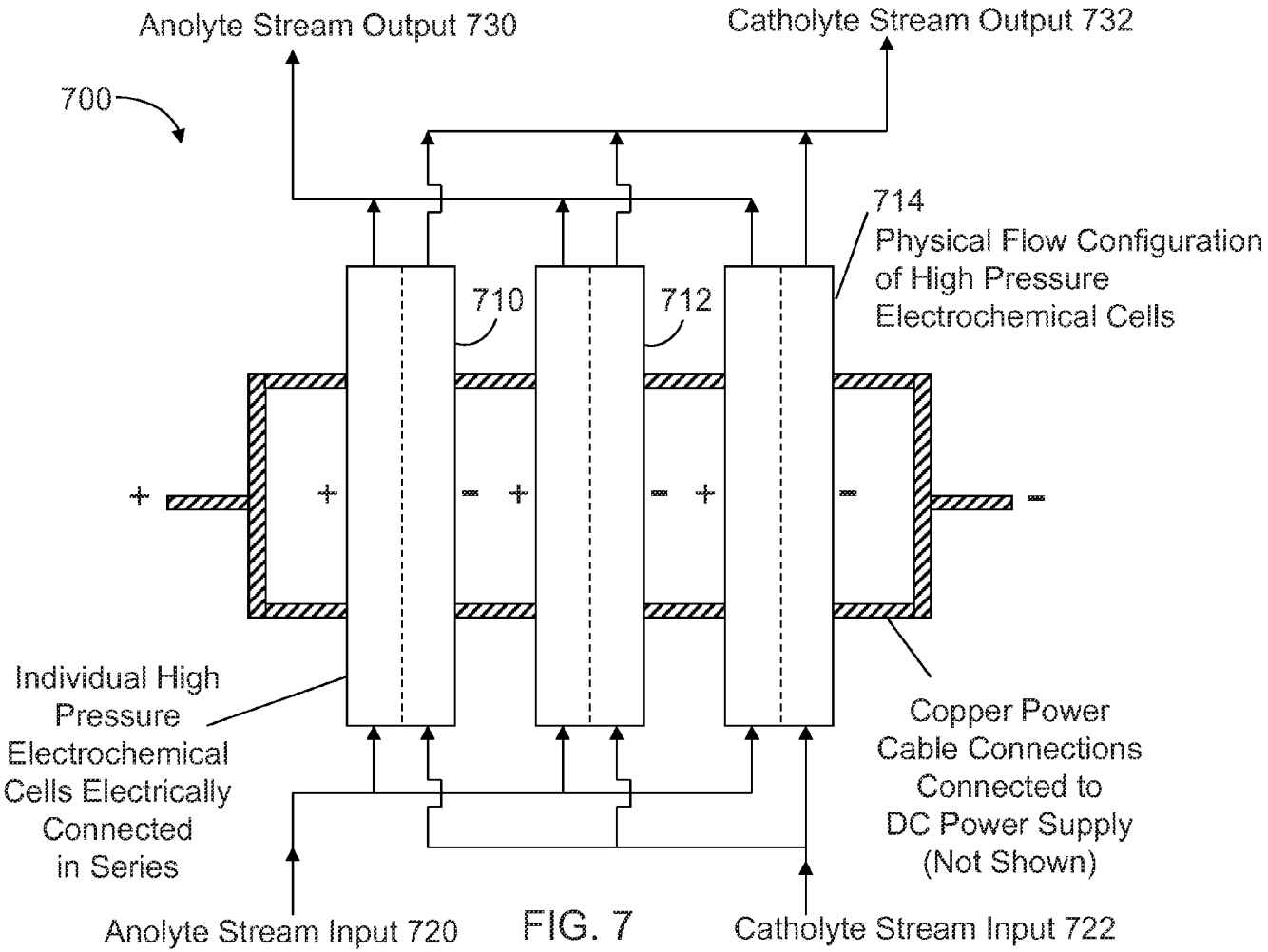
FIG. 7 depicts a system for operating multiple high pressure electrochemical cells in simultaneous operation in accordance with an embodiment of the present disclosure.

Referring to FIG. 7, a system 700 for operating multiple high pressure electrochemical cells 710, 712, and 714 in simultaneous operation in accordance with an embodiment of the present disclosure is shown. It is contemplated that electrochemical cells 710-714 may be implemented via one or more of electrochemical cells 100, 400 of FIGS. 1A-1B and FIGS. 4A-4C and as previously described. It is further contemplated that electrochemical cells 710-714 may be electrically connected in a monopolar or bipolar electrical configuration as needed for matching the voltage and current of the DC rectifiers used. This may be advantageous as it may reduce the cost and complexity of the electrical equipment needed to provide the power sufficient to handle the electrochemical cells which requires a high voltage but less current. It is further contemplated that a single source of anolyte 720 and a single source of catholyte 722 may be distributed to each electrochemical cell 710-714. Additionally, a single anolyte output 730 and a single catholyte output 732 may collect the output of each electrochemical cell 710-714.

A number of experimental lab tests employing a high pressure electrochemical cell as described in this disclosure were conducted to develop an electrochemical process for the reduction of carbon dioxide to $C_1$ and $C_{2+}$ chemicals. The system selected first for the development of an electrochemical process was formic acid, produced as the acid form or as formate. In this application, the electrochemical production of formate is used as the example of one of the embodiments of the electrochemical process.

It is contemplated that the electrochemical cells of the present disclosure may be suitable for carbon dioxide reduction, particularly reduction to a formate. It is contemplated that reduction of $CO_2$ at the cathode in an aqueous solvent system is as follows.

Hydrogen atoms are adsorbed at the electrode from the reduction of water as shown in equation (1).

$$H^+ + e^- \rightarrow H_{ad} \quad (1)$$

Carbon dioxide is reduced at the cathode surface with the adsorbed hydrogen atom to form formate, which is adsorbed on the surface as in equation (2).

$$CO_2 + H_{ad} \rightarrow HCOO_{ad} \quad (2)$$

The adsorbed formate adsorbed on the surface then reacts with another adsorbed hydrogen atom to form formic acid that is released into the solution as in equation (3)

$$HCOO_{ad} + H_{ad} \rightarrow HCOOH \quad (3)$$

The competing reaction at the cathode is the reduction of water where hydrogen gas is formed as well as hydroxide ions as in equation (4).

$$2H_2O + 2e^- \rightarrow H_2 + 2OH^- \quad (4)$$

In observations of the operation of the electrochemical cells of the present disclosure in the present aqueous based system, the addition of bicarbonate in the catholyte solution and utilizing an acidic anolyte, it was noted that the pH of the catholyte solution declines with time, and two types of bubbles are seen in the catholyte output stream—large bubbles and a lower concentration of very fine bubbles in the output stream of the catholyte compartment. It is contemplated that the large bubbles are composed of $CO_2$ from the proton or hydrogen ion decomposition of bicarbonate to $CO_2$ and water and that the very fine bubbles are byproduct hydrogen. It is contemplated that the hydrogen ions or protons passing through the membrane are decomposing some of the bicarbonate to $CO_2$ and water within the electrode material, and possibly very close to the electrode surfaces, providing a higher $CO_2$ partial pressure environment, and resulting in higher current efficiencies at low operating partial pressures of dissolved $CO_2$ in the solution at ambient operating pressures.

Anode Reaction

The anode reaction may include oxidation of water into oxygen and hydrogen ions as shown in equation (5).

$$2H_2O \rightarrow 4H^+ + 4e^- + O_2 \quad (5)$$

Below are the various preferred and alternative embodiments for the process, arranged in different categories.

It is further contemplated that the structure and operation of the electrochemical cell may be adjusted to provide desired results. For example, the electrochemical cell may operate at higher pressures, such as pressure above atmospheric pressure which may increase current efficiency and allow operation of the electrochemical cell at higher current densities.

Additionally, the cathode and anode may include a high surface area electrode structure with a void volume which may range from 30% to 98%. The electrode void volume percentage may refer to the percentage of empty space that the electrode is not occupying in the total volume space of the electrode. The advantage in using a high void volume electrode is that the structure has a lower pressure drop for liquid flow through the structure. The specific surface area of the electrode base structure may be from 2 $cm^2/cm^3$ to 500 $cm^2/cm^3$ or higher. The electrode specific surface area is a ratio of the base electrode structure surface area divided by the total physical volume of the entire electrode. It is contemplated that surface areas also may be defined as a total area of the electrode base substrate in comparison to the projected geometric area of the current distributor/conductor back plate, with a preferred range of 2× to 1000× or more. The actual total active surface area of the electrode structure is a function of the properties of the electrode catalyst deposited on the physical electrode structure which may be 2 to 1000 times higher in surface area than the physical electrode base structure.

It is contemplated that the cathode may be gradated or graduated such that a density of the cathode may be varied in the vertical or horizontal directions in terms of density, void volume, or specific surface area (e.g. varying fiber sizes). The cathode structure may also include two or more different catalyst compositions that are either mixed or located in separate regions of the cathode structure in the catholyte compartment.

For the electrochemical reduction of carbon dioxide to generate formate, indium coatings on a Sn-coated copper woven mesh, copper screen, copper fiber is suitable. Indium-Cu intermetallics may be formed on copper fiber, woven mesh, copper screen. The intermetallics are harder than the soft indium metal, and allow better mechanical properties in addition to usable catalytic properties. The cathode may also include, but not limited to coatings or combinations of coatings in a single or plurality of layers on the cathode containing Pb, Sn, Hg, Tl, In, Bi, and Cd, their alloys, oxides, and combinations thereof for the production of formic acid. Metals including Ti, Nb, Cr, Mo, Ag, Cd, Hg, Tl, As, Ni, and Pb as well as Cr—Ni—Mo steel alloys, their coatings on metal substrates and carbon, among many other metals and their combinations may be incorporated for the formation of $C_{2+}$ products, including oxalic acid and glycolic acid when used in non-aqueous catholytes. It is further contemplated that the cathode may also include, but not limited to coatings or combinations of coatings in a single or plurality of layers on the cathode containing Pb, Sn, Hg, Tl, In, Bi, and Cd, their alloys, oxides, and combinations thereof for the production of formic acid. Metals including Ti, Nb, Cr, Mo, Ag, Cd, Hg, Tl, As, Ni, and Pb as well as Cr—Ni—Mo steel alloys, their coatings on metal substrates and carbon in specific locations and portions of the cathode. For example, catalyst coating may be applied in portions of the cathode such as the shell, current distributor and high surface area cathode material.

In an alternative embodiment, the cathode surfaces may be renewed by the periodic addition of indium salts or a mix of indium/tin salts in situ during cell operation. The electrochemical cell may be operated at full rate during operation, or temporarily operated at a lower current density with or without any carbon dioxide addition during the injection of the metal salts. The conditions under which the best renewal of the cathode surface with the addition of these salts would be easily determined by experimentation by those skilled in the art. Additionally, in another embodiment, in preparing cathode materials for the production of $C_{2+}$ chemicals, the addition of metal salts that may electrochemically reduce carbon dioxide on the surfaces of the cathode structure may be also used, such as the addition of Ag, Au, Mo, Cd, Ni, Sn, etc. to provide a catalytic surface that may be difficult to prepare directly during cathode fabrication or for renewal of the catalytic surfaces. Metal and composite coatings may be applied by electroplating, chemical vapor deposition, and other suitable methods.

It is contemplated the catholyte may include a pH which may range from 2 to 12. The selection of the heterogeneous catalysts used (such as the metal electrodes), is such that there is no corrosion of the cathodes in the electrochemical cell at the catholyte operating conditions. Homogeneous catalysts may also be added to the catholyte solution to help promote and lower the potential for the cathodic electrochemical reduction of carbon dioxide at the cathode. The homogeneous catalysts may include a homogenous heterocyclic catalyst utilized in the catholyte. The homogenous heterocyclic catalyst may include, for example, one or more of 4-hydroxy pyridine, adenine, a heterocyclic amine containing sulfur, a heterocyclic amine containing oxygen, an azole, a benzimidazole, a bipyridine, furan, an imidazole, an imidazole related species with at least one five-member ring, an indole, a lutidine, methylimidazole, an oxazole, phenanthroline, pterin, pteridine, a pyridine, a pyridine related species with at least one six-member ring, pyrrole, quinoline, or a thiazole, and mixtures thereof.

For the aqueous formate system, aqueous alkali metal bicarbonates, carbonates, sulfates, and phosphates, etc. are suitable as cathode electrolytes. Other electrolytes include borates, ammonium and ammonia, alkali metal hydroxides, as well as alkali metal chlorides, bromides, and other inorganic and inorganic salts. Non-aqueous solvents may be utilized, such as propylene carbonate, methanesulfonic acid, methanol, and other ionic conducting liquids, as well as ionic liquids, and aprotic solvents, which may be in an aqueous mixture, or as a non-aqueous mixture in the catholyte with or without the addition of electrolyte conductive salts such as tetrabutylammonium bromide and the like if the solvent or ionic liquid is not conductive. The introduction of micro bubbles of carbon dioxide into the catholyte stream may also be added to improve carbon dioxide transfer to the cathode surfaces.

The anolyte electrolytes may include alkali metal hydroxides, such as KOH, NaOH, LiOH in addition to ammonium hydroxide; Inorganic acids such as sulfuric, phosphoric, hydrochloric, and the like; organic acids such as methanesulfonic acid, both non-aqueous and aqueous solutions; and aqueous solutions of alkali halide salts, such as the chlorides, bromides, and iodine types such as NaCl, NaBr, LiBr, and NaI. The alkali halide salts may produce, for example, chlorine, bromine, or iodine as halide gas or dissolved aqueous products from the anolyte compartment. Methanol or other hydrocarbon non-aqueous liquids as well as aprotic solvents, may also be used as the solvent, and the salts would form some oxidized products in the anolyte. Selection of the anolyte may be determined by the process chemistry product and requirements for reducing the overall operating cell voltage. For example, the formation of bromine, from the oxidation of bromide containing salts dissolved in the anolyte, on the anode requires a significantly lower anode voltage than chlorine formation, and iodine is even less than that of bromine. The catholyte and anolyte may also be of the same composition, such as in the case of using aprotic solvents with a conductive salt addition.

The anolyte flow rate may include a cross sectional area flow rate range of 2-3,000 gpm/ft$^2$ or more (0.0076-11.36 m$^3$/m$^2$). The anolyte flow velocity may range from 0.002 to 20 ft/sec (0.006 to 6.1 m/sec).

The catholyte flow rate may include a cross sectional area flow rate range of 2-3,000 gpm/ft$^2$ or more (0.0076-11.36 m$^3$/m$^2$). The catholyte flow velocity may range from 0.002 to 20 ft/sec (0.0006 to 6.1 m/sec). The cathode electrolyte may also contain homogeneous catalysts which may promote the $CO_2$ reduction reaction, as described in U.S. patent application Ser. No. 12/846,221 filed Jul. 29, 2010, U.S. patent application Ser. No. 13/307,965 filed Nov. 30, 2011, U.S. patent application Ser. No. 13/340,733 filed Dec. 30, 2011, U.S. patent application Ser. No. 13/724,885 filed Dec. 21, 2012 and U.S. patent application Ser. No. 13/724,988 filed Dec. 21, 2012. The U.S. patent application Ser. No. 12/846,221 filed Jul. 29, 2010, U.S. patent application Ser. No. 13/307,965 filed Nov. 30, 2011, U.S. patent application Ser. No. 13/340,733 filed Dec. 30, 2011, U.S. patent application Ser. No. 13/724,885 filed Dec. 21, 2012 and U.S. patent application Ser. No. 13/724,988 filed Dec. 21, 2012 are hereby incorporated by reference in their entirety.

Example Electrochemical Cell Design

The electrochemical cell design used in laboratory examples may incorporate various thickness high surface area cathode structures using added spacer frames and also provide the physical contact pressure for the electrical contact to the cathode current conductor backplate.

An electrochemical bench scale cell with an electrode projected area of about 108 cm$^2$ was used for much of the bench scale test examples. The electrochemical cell was constructed consisting of two electrode compartments machined from 1.0 inch (2.54 cm) thick natural polypropylene. The outside dimensions of the anode and cathode compartments were 8 inches (20.32 cm) by 5 inches (12.70 cm) with an internal machined recess of 0.375 inches (0.9525 cm) deep and 3.0 inches (7.62 cm) wide by 6 inches (15.24 cm) tall with a flat gasket sealing area face being 1.0 inches (2.52 cm) wide. Two holes were drilled equispaced in the recess area to accept two electrode conductor posts that pass though the compartment thickness, and having two 0.25 inch (0.635 cm) drilled and tapped holes to accept a plastic fitting that passes through 0.25 inch (0.635 cm) conductor posts and seals around it to not allow liquids from the electrode compartment to escape to the outside. The electrode frames were drilled with an upper and lower flow distribution hole with 0.25 inch pipe threaded holes with plastic fittings installed to the outside of the cell frames at the top and bottom of the cells to provide flow into and out of the cell frame, and twelve 0.125 inch (0.3175 cm) holes were drilled through a 45 degree bevel at the edge of the recess area to the upper and lower flow distribution holes to provide an equal flow distribution across the surface of the flat electrodes and through the thickness of the high surface area electrodes of the compartments.

For the anode compartment cell frames, an anode with a thickness of 0.060 inch (0.1524 cm) and 2.875 inch (7.3025 cm) width and 5.875 inch (14.9225 cm) length with two 0.25 inch (0.635 cm) titanium diameter conductor posts welded on the backside were fitted through the two holes drilled in the electrode compartment recess area. The positioning depth of the anode in the recess depth was adjusted by adding plastic spacers behind the anode, and the edges of the anode to the cell frame recess were sealed using a medical grade epoxy. The electrocatalyst coating on the anode was a Water Star WS-32, an iridium oxide based coating on a 0.060 inch (0.1524 cm) thick titanium substrate, suitable for oxygen evolution in acids. In addition, the anode compartment also employed an anode folded screen (folded three times) that was placed between the anode and the membrane, which was a 0.010 inch (0.0254 cm) thick titanium expanded metal material from DeNora North America (EC626), with an iridium oxide based oxygen evolution coating, and used to provide a zero gap anode configuration (anode in contact with membrane), and to provide pressure against the membrane from the anode side which also had contact pressure from the cathode side.

For the cathode compartment cell frames, 316L stainless steel cathodes with a thickness of 0.080 inch (0.2032 cm) and 2.875 inch (7.3025 cm) width and 5.875 inch (14.9225 cm) length with two 0.25 inch (0.635 cm) diameter 316L SS conductor posts welded on the backside were fitted through the two holes drilled in the electrode compartment recess area. The positioning depth of the cathode in the recess depth was adjusted by adding plastic spacers behind the cathode, and the edges of the cathode to the cell frame recess were sealed using a fast cure medical grade epoxy.

A copper bar was connected between the two anode posts and the cathode posts to distribute the current to the electrode back plate. The cell was assembled and compressed using 0.25 inch (0.635 cm) bolts and nuts with a compression force of about 60 in-lbs force. Neoprene elastomer gaskets (0.0625 inch (0.159 cm) thick) were used as the sealing gaskets between the cell frames, frame spacers, and the membranes.

Example 1

The above cell was assembled with a 0.010 inch (0.0254 cm) thickness indium foil mounted on the 316L SS back conductor plate using a conductive silver epoxy. A multi-layered high surface area cathode, comprising an electrolessly applied indium layer of about 1 micron thickness that was deposited on a previously applied layer of electroless tin with a thickness of about 25 micron thickness onto a woven copper fiber substrate. The base copper fiber structure was a copper woven mesh obtained from an on-line internet supplier, PestMall.com (Anteater Pest Control Inc.). The copper fiber dimensions in the woven mesh had a thickness of 0.0025 inches (0.00635 cm) and width of 0.010 inches (0.0254 cm). The prepared high surface area cathode material was folded into a pad that was 1.25 inches (3.175 cm) thick and 6 inches (15.24 cm) high and 3 inches (7.62 cm) wide, which filled the cathode compartment dimensions and exceeded the adjusted compartment thickness (adding spacer) which was 0.875 inches (2.225 cm) by about 0.25 inches (0.635 cm). The prepared cathode had a calculated surface area of about 3,171 cm$^2$, for an area about 31 times the flat cathode plate area, with a 91% void volume, and specific surface area of 12.3 $cm^2/cm^3$. The cathode pad was compressible, and provided the spring force to make contact with the cathode plate and the membrane. Two layers of a very thin (0.002 inches thick) plastic screen with large 0.125 inch (0.3175 cm) holes were installed between the cathode mesh and the Nafion® 324 membrane. Neoprene gaskets (0.0625 inch (0.159 cm) thick) were used as the sealing gaskets between the cell frames and the membranes. The electrocatalyst coating on the anode in the anolyte compartment was a Water Star WS-32, an iridium oxide based coating, suitable for oxygen evolution in acids. In addition, the anode compartment also employed a three-folded screen that was placed between the anode and the membrane, which was a 0.010 inch (0.0254 cm) thick titanium expanded metal material from DeNora North America (EC626), with an iridium oxide based oxygen evolution coating, and used to provide a zero gap anode configuration (anode in contact with membrane), and to provide pressure against the membrane from the anode side which also had contact pressure from the cathode side.

The cell assembly was tightened down with stainless steel bolts, and mounted into the cell station, which has the same configuration as shown in FIG. 1 with a catholyte disengager, a centrifugal catholyte circulation pump, inlet cell pH and outlet cell pH sensors, a temperature sensor on the outlet solution stream. A 5 micron stainless steel frit filter was used to sparge carbon dioxide into the solution into the catholyte disengager volume to provide dissolved carbon dioxide into the recirculation stream back to the catholyte cell inlet.

The anolyte used was a dilute 5% by volume sulfuric acid solution, made from reagent grade 98% sulfuric acid and deionized water.

In this test run, the system was operated with a catholyte composition containing 0.4 molar potassium sulfate aqueous with 2 gm/L of potassium bicarbonate added, which was sparged with carbon dioxide to an ending pH of 6.60.

Operating Conditions:

Batch Catholyte Recirculation Run

Anolyte Solution: 0.92 M $H_2SO_4$

Catholyte Solution: 0.4 M $K_2SO_4$, 0.14 mM $KHCO_3$

Catholyte flow rate: 2.5 LPM

Catholyte flow velocity: 0.08 ft/sec

Applied cell current: 6 amps (6,000 mA)

Catholyte pH range: 5.5-6.6, controlled by periodic additions of potassium bicarbonate to the catholyte solution recirculation loop.

Catholyte pH declines with time, and is controlled by the addition of potassium bicarbonate.

Results:

Cell voltage range: 3.39-3.55 volts (slightly lower voltage when the catholyte pH drops)

Run time: 6 hours

Formate Faradaic yield: Steady between 32-35%, calculated taking samples periodically. See FIG. 7.

Final formate concentration: 9,845 ppm

In this test run, the system was operated with a catholyte composition containing 0.4 molar potassium sulfate aqueous with 2 gm/L of potassium bicarbonate added, which was sparged with carbon dioxide to an ending pH of 6.60.

Example 2

The same cell as in Example 1 was used with the same cathode, which was only rinsed with water while in the electrochemical cell after the run was completed and then used for this run.

In this test run, the system was operated with a catholyte composition containing 0.375 molar potassium sulfate aqueous with 40 gm/L of potassium bicarbonate added, which was sparged with carbon dioxide to an ending pH of 7.05.

Operating Conditions:

Batch Catholyte Recirculation Run

Anolyte Solution: 0.92 M $H_2SO_4$

Catholyte Solution: 0.4 M $K_2SO_4$, 0.4 M $KHCO_3$

Catholyte flow rate: 2.5 LPM

Catholyte flow velocity: 0.08 ft/sec

Applied cell current: 6 amps (6,000 mA)

Catholyte pH range: Dropping from 7.5 to 6.75 linearly with time during the run.

Results:

Cell voltage range: 3.40-3.45 volts

Run time: 5.5 hours

Formate Faradaic yield: Steady at 52% and slowly declining with time to 44% as the catholyte pH dropped. See FIG. 8.

Final formate concentration: 13,078 ppm

Example 3

The same cell as in Examples 1 and 2 was used with the same cathode, which was only rinsed with water while in the electrochemical cell after the run was completed and then used for this run.

In this test run, the system was operated with a catholyte composition containing 0.200 molar potassium sulfate aqueous with 40 gm/L of potassium bicarbonate added, which was sparged with carbon dioxide to an ending pH of 7.10.

Operating Conditions:

Batch Catholyte Recirculation Run

Anolyte Solution: 0.92 M $H_2SO_4$

Catholyte Solution: 0.2 M $K_2SO_4$, 0.4 M $KHCO_3$

Catholyte flow rate: 2.5 LPM

Catholyte flow velocity: 0.08 ft/sec

Applied cell current: 9 amps (9,000 mA)

Catholyte pH range: Dropping from 7.5 to 6.65 linearly with time during the run, and then additional solid $KHCO_3$ was added to the catholyte loop in 10 gm increments at the 210, 252, and 290 minute time marks which brought the pH back up to about a pH of 7 for the last part of the run.

Results:

Cell voltage range: 3.98-3.80 volts

Run time: 6.2 hours

Formate Faradaic yield: 75% declining to 60% at a pH of 6.65, and then increasing to 75% upon the addition of solid potassium bicarbonate to the catholyte to the catholyte loop in 10 gm increments at the 210, 252, and 290 minute time marks and slowly declining down with time 68% as the catholyte pH dropped to 6.90. See FIG. 9.

Final formate concentration: 31,809 ppm.

Example 4

The same cell as in Examples 1, 2, and 3 was used with the same cathode, which was only rinsed with water while in the electrochemical cell after the run was completed and then used for this run.

In this test run, the system was operated with a catholyte composition containing 1.40 molar potassium bicarbonate (120 gm/L $KHCO_3$), which was sparged with carbon dioxide to an ending pH of 7.8.

Operating Conditions:

Batch Catholyte Recirculation Run

Anolyte Solution: 0.92 M $H_2SO_4$

Catholyte Solution: 1.4 M $KHCO_3$
Catholyte flow rate: 2.6 LPM
Catholyte flow velocity: 0.09 ft/sec
Applied cell current: 11 amps (11,000 mA)
Catholyte pH range: Dropping from around 7.8 linearly with time during the run to a final pH of 7.48
Results:
Cell voltage range: 3.98-3.82 volts
Run time: 6 hours
Formate Faradaic yield: 63% and settling down to about 54-55%. See FIG. 10.
Final formate concentration: 29,987 ppm.

Example 5

The same cell as in Examples 1, 2, and 3 was used with a newly prepared indium on tin electrocatalyst coating on a copper mesh cathode. The prepared cathode had calculated surface areas of about 3,171 $cm^2$, for an area about 31 times the flat cathode plate area, with a 91% void volume, and specific surface area of 12.3 $cm^2/cm^3$.

In this test run, the system was operated with a catholyte composition containing 1.40 M potassium bicarbonate (120 gm/L $KHCO_3$), which was sparged with $CO_2$ to an ending pH of 7.8 before being used.

The cells were operated in a recirculating batch mode for the first 8 hours of operation to get the catholyte formate ion concentration up to about 20,000 ppm, and then a fresh feed of 1.4 M potassium bicarbonate was metered into the catholyte at a feed rate of about 1.2 mL/min. The overflow volume was collected and volume measured, and the overflow and catholyte loop sample were sampled and analyzed for formate by ion chromatography.

Operating Conditions:
Cathode: Electroless indium on tin on a copper mesh substrate
Continuous Feed with Catholyte Recirculation Run—11.5 days
Anolyte Solution: 0.92 M $H_2SO_4$
Catholyte Solution: 1.4 M $KHCO_3$
Catholyte flow rate: 3.2 LPM
Catholyte flow velocity: 0.09 ft/sec
Applied cell current: 6 amps (6,000 mA)
Results:
Cell voltage versus time: FIG. 15 illustrates results of cell voltage versus time, displaying a stable operating voltage of about 3.45 volts over the 11.5 days after the initial start-up.
Continuous Run time: 11.5 days
Formate Concentration Versus Time: FIG. 16 shows results of the formate concentration versus time.
Formate Faradaic yield: FIG. 17 illustrates the calculated formate current efficiency versus time measuring the formate yield from the collected samples.
Final formate concentration: About 28,000 ppm.
Catholyte pH: FIG. 18 illustrates the catholyte pH change over the 11.5 days, which slowly declined from a pH of 7.8 to a pH value of 7.5. The feed rate was not changed during the run, but could have been slowly increased or decreased to maintain a constant catholyte pH in any optimum operating pH range.

Example 6

The same cell as in Examples 1, 2, and 3 was used with a newly prepared indium on tin electrocatalyst coating on a copper mesh cathode. The prepared cathode had calculated surface areas of about 3,171 $cm^2$, for an area about 31 times the flat cathode plate area, with a 91% void volume, and specific surface area of 12.3 $cm^2/cm^3$.

In this test run, the system was operated with a catholyte composition containing 1.40 M potassium bicarbonate (120 gm/L $KHCO_3$), which was sparged with $CO_2$ to an ending pH of 7.8 before being used.

The cells were operated in a recirculating batch mode for the first 8 hours of operation to get the catholyte formate ion concentration up to about 20,000 ppm, and then a fresh feed of 1.4 M potassium bicarbonate was metered into the catholyte at a feed rate of about 1.2 mL/min. The overflow volume was collected and volume measured, and the overflow and catholyte loop sample were sampled and analyzed for formate by ion chromatography.

Operating Conditions:
Cathode: Electroless indium on tin on a copper mesh substrate
Continuous Feed with Catholyte Recirculation Run—21 days
Anolyte Solution: 0.92 M $H_2SO_4$
Catholyte Solution: 1.4 M $KHCO_3$
Catholyte flow rate: 3.2 LPM
Catholyte flow velocity: 0.09 ft/sec
Applied cell current: 6 amps (6,000 mA)
Results:
Cell voltage versus time: The cell showed a higher operating voltage of about 4.40 volts, higher than all of our other cells, because of an inadequate electrical contact pressure of the cathode against the indium foil conductor back plate. The cell maintained operation for an extended run.
Continuous Run time: 21 days It is contemplated that operating the electrochemical cell catholyte at a higher operating pressure may allow more dissolved $CO_2$ to dissolve in the aqueous electrolyte. Typically, electrochemical cells may operate at pressures up to about 20 to 30 psig in multi-cell stack designs, although with modifications, they could operate at up to 100 psig. The electrochemical cell of the present disclosure may operate at pressure of 2 to 100 or more atmospheres, and as high as 200 to 500 atmospheres. The electrochemical cell may operate into the liquid $CO_2$ and supercritical $CO_2$ operating range.

It is contemplated that the catholyte operating temperature and the anolyte operating temperature may range from −10 to 95° C., more preferably 5-60° C. The lower temperature will be limited to the electrolytes used and their freezing points. In general, the lower the temperature, the high the solubility of $CO_2$ in the aqueous solution phase of the electrolyte, and would help in obtaining higher conversion and current efficiencies. A drawback is that the operating electrochemical cell voltages may be higher, so there is an optimization that would be done to produce the chemicals at the lowest operating cost. The operating cell voltage of the electrochemical cell may range from 0.5 volts to 20 volts, which is dependent on the operating current density of the cell, the conductivity of the anolyte and catholyte solutions in the cell, the selected separator or membrane, and the operating temperature of the cell.

The electrochemical cell may employ a zero gap type cell design with the membrane or separator pressed directly against the cathode and the anode. An open area non-conductive screen may be used between membrane and the high surface area cathode material.

Anode coatings for aqueous acid anolytes oxidizing water to generate oxygen, the preferred catalytic coatings may include: precious metal oxides such as ruthenium and iridium oxides, as well as platinum and gold and their combinations as metals and oxides on valve metal substrates such as titanium, tantalum, or niobium as typically used in the chlor alkali industry or other electrochemical processes which are stable as anodes. For other anolytes such as alkaline or hydroxide electrolytes: these include carbon, cobalt oxides, nickel and stainless steels, and their alloys and combinations, and transition metal oxide coatings on metal substrates which are stable as anodes under alkaline conditions. Other anode materials, suitable for non-oxygen generating systems, include carbon, graphite, RVC, as well are carbon and graphite based felts, needled felts, woven structures and the like, which may also have applied metal or metal oxide coatings or electrocatalysts on the surfaces of the anode for the generation of halogens such as bromine, chlorine, and iodine. The catalysts may include precious metal and precious metal oxides such as ruthenium oxide, or metals such as platinum.

It is further contemplated that catalyst coatings for the anode may be selectively applied in various regions of the anode. For example, catalyst coating may be applied in portions of the anode such as the shell, current distributor and high surface area anode material.

The electrochemical cell may include cation ion exchange type membranes, especially those that have a high rejection efficiency to anions, for example, perfluorinated sulfonic acid based ion exchange membranes such as DuPont Nafion brand unreinforced types N117 and N120 series, more preferred PTFE fiber reinforced N324 and N424 types, and similar related membranes manufactured by Japanese companies under the supplier trade names such as Flemion.

Other types of membranes may be multi-layer perfluorinated ion exchange membranes used in the chlor alkali industry that may have a bilayer construction of a sulfonic acid based membrane layer bonded to a carboxylic acid based membrane layer, which efficiently operates with an anolyte and catholyte above a pH of about 2 or higher. These membranes have much higher anion rejection efficiency. These are sold by DuPont under their Nafion trademark as the N900 series, such as the N90209, N966, N982, and the 2000 series, such as the N2010, N2020, and N2030 and all of their types and subtypes.

Another type of membrane may be hydrocarbon based membranes, which are made from various cation ion exchange materials may be used as well as anion membranes if the anion rejection is not as critical, such as those sold by Sybron under their trade name Ionac, ACG Engineering (Asahi Glass) under their Selemion trade name, and Tokuyama Soda among others on the market. Separators may also be employed, such as those used in lithium battery separators or diaphragms comprising polymers such as PVDF (polyvinylidiene difluoride), PTFE, polypropylene, polyethylene, and other suitable chemically compatible polymer materials.

The electrochemical cell may be operated in a horizontal position, with the anode being in a horizontal position, facing downward, such that the anode does not operate in any gas phase that may be produced in the anolyte, or operated in a vertical position where any gases formed can rise and exit the electrochemical cell. The electrochemical cell design may be suitable for other electrochemical processes, including chlor alkali, partial organic oxidation and reduction processes, and other electrochemical processes where higher pressures may improve reaction rates or yields.

One example is a set of high pressure experiments with $CO_2$ using a Parr (Parr Instrument Company) pressure vessel to determine the potential increase in current density when operating the system at higher pressures. The solution was a 0.5 molar solution potassium chloride solution with or without a 2-picoline catalyst in the catholyte solution. The anolyte is a 0.5 M potassium sulfate solution without the catalyst. The cathode was a tin foil and the counter electrode was platinum. A glass frit separator was used between the anolyte and catholyte. Carbon dioxide under pressure was used to saturate the solution with dissolved carbon dioxide and used in the gas space above the cell.

| Cathode/Catalyst | Pressure in atmospheres | Temperature ° C. | Faradaic Yield % | Current Density mA/cm$^2$ |
|---|---|---|---|---|
| Tin/no catalyst | 1 | 20 | 7-10 | 1.0 |
| Tin/no catalyst | 54 | 20 | 14 | 4.0 |
| Tin/no catalyst | 54 | 60 | 12 | 8.0 |
| Tin/2-Picoline catalyst 30 mM concentration | 1 | 20 | 15-20 | 2.0 |
| Tin/2-Picoline catalyst 30 mM concentration | 54 | 20 | 34-44 | 7-11 |
| Tin/2-Picoline catalyst 30 mM concentration | 54 | 60 | 26 | 15 |

The experiment shows that high pressure with carbon dioxide helps to achieve a higher current density at 54 atmospheres in comparison to room temperature by a factor or 4 for the non-catalyst system, and increased temperature to 60° C. helps increase the current density by a factor of 8.

In the system with the 2-picoline catalyst added in the catholyte, the Faradaic yield was improved by a factor of about 2 over the non-catalyst system. The current density was able to be increased by a factor of about 3 at 54 atmospheres at room temperature, and by a factor of about 8 at 60° C.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. An electrochemical cell, comprising:

an exterior pressure vessel, the exterior pressure vessel including:

a cylindrical body, the cylindrical body being formed of a first semicircular section and a second semi-circular section which are removably fastened together;

a first end removably fastened to the cylindrical body to cover a first opening of the cylindrical body;

a second end removably fastened to the cylindrical body to cover a second opening of the cylindrical body;

an anode, the anode including a semi-circular section and a flat portion connected to the semi-circular portion, the anode being connected to the first semicircular section of the cylindrical body; and a cathode, the cathode including a semi-circular section and a flat portion connected to the semi-circular portion, the cathode being connected to the second semi-circular section of the cylindrical body; and a membrane, the membrane located between the anode and cathode, the membrane configured to control a flow of ions between the anode and the cathode.

2. The electrochemical cell of claim 1, wherein one of the first end or the second end is a flat structure.

3. The electrochemical cell of claim 1, wherein one of the first end or the second end is a cylindrical dome structure.

4. The electrochemical cell of claim 1, wherein the flat portion of the anode is a perforated metal screen.

5. The electrochemical cell of claim 1, wherein the flat portion of the cathode includes a cathode current distributor and a catalyst coating.

6. The electrochemical cell of claim 1, wherein the first end includes an anolyte inlet port and a catholyte inlet port and the second end includes an anolyte outlet port and a catholyte outlet port.

7. The electrochemical cell of claim 6, further comprising a pressure controller connected to at least one of the anolyte inlet, anolyte outlet, catholyte inlet or catholyte outlet.

8. The electrochemical cell of claim 1, wherein the anode has a length approximately a length of the cylindrical body.

9. The electrochemical cell of claim 1, wherein the cathode has a length approximately the length of the cylindrical body.

* * * * *